US008086126B2

(12) United States Patent
Hotogi et al.

(10) Patent No.: US 8,086,126 B2
(45) Date of Patent: Dec. 27, 2011

(54) IMAGE FORMING APPARATUS WITH HIGH-VOLTAGE POWER SUPPLY

(75) Inventors: Tatsuya Hotogi, Suntou-gun (JP); Shimpei Matsuo, Tokyo (JP); Eijiro Ohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 485 days.

(21) Appl. No.: 12/327,334

(22) Filed: Dec. 3, 2008

(65) Prior Publication Data

US 2009/0154942 A1 Jun. 18, 2009

(30) Foreign Application Priority Data

Dec. 13, 2007 (JP) ..... 2007-322544
Nov. 13, 2008 (JP) ..... 2008-291503

(51) Int. Cl.
*G03G 15/08* (2006.01)
*G03G 15/00* (2006.01)

(52) U.S. Cl. ..... 399/61; 399/88

(58) Field of Classification Search ..... 399/61, 399/62, 27, 88; 118/694
See application file for complete search history.

(56) References Cited

U.S. PATENT DOCUMENTS 6,892,035 B2 * 5/2005 Matsumoto et al. ..... 399/27
7,139,501 B2 * 11/2006 Takami et al. ..... 399/89

FOREIGN PATENT DOCUMENTS

| | | | |
|---|---|---|---|
| JP | 04352180 A | * | 12/1992 |
| JP | 05176557 A | * | 7/1993 |
| JP | 8-44184 A | | 2/1996 |
| JP | 08149829 A | * | 6/1996 |
| JP | 2000-131936 A | | 5/2000 |
| JP | 2004177765 A | * | 6/2004 |
| JP | 2007025251 A | * | 2/2007 |

* cited by examiner

*Primary Examiner* — Robert Beatty
(74) *Attorney, Agent, or Firm* — Fitzpatrick, Cella, Harper & Scinto

(57) ABSTRACT

An image forming apparatus comprises a developer carrier (101) for developing an electrostatic latent image by supplying an image carrier with developer inside a developer container (100); an electrode member (104) opposing the developer carrier (101) via a space accommodating the developer; an inverter (301); a transformer (302) for transforming an AC voltage from the inverter (301); a rectifying circuit (303) for rectifying the output of the transformer and generating a DC voltage for image formation; a DC voltage applying unit (306) for applying the AC voltage, which is output from the transformer, to the electrode member (104); and a developer remaining-amount detection unit (305) for detecting amount of developer remaining inside the developer container (100) based upon electrostatic capacitance between the developer carrier (101) and electrode member (104).

14 Claims, 14 Drawing Sheets

IMAGE FORMING APPARATUS WITH HIGH-VOLTAGE POWER SUPPLY

BACKGROUND OF THE INVENTION

1. Field of the Invention

The present invention relates to an image forming apparatus adapted to detect amount of remaining toner.

2. Description of the Related Art

An electrostatic capacitance detection method described in Japanese Patent Application Laid-Open No. 8-44184 and a light transmission method described in Japanese Patent Application Laid-Open No. 2000-131936 are used as mechanisms for detecting amount of toner remaining in an electrophotographic image forming apparatus. Detection of remaining amount of toner according to the electrostatic capacitance detection method is used as a technique ideal for application primarily to an image forming apparatus having an AC bias power supply for non-contact development, such as a monochrome image forming apparatus. Detection of remaining amount of toner according to the light transmission method is used as a technique ideal for application primarily to an image forming apparatus, such as a color image forming apparatus, which performs contact development of non-magnetic toner by DC bias and which does not have an AC bias power supply for development.

FIG. 16 illustrates the configuration of an image forming apparatus as one example of an electrophotographic image forming apparatus. In the image forming apparatus shown in FIG. 16, a charging roller 2 serving as charging means uniformly charges the surface of a photosensitive drum 1 serving as an image carrier. An exposure unit 3 then subjects the surface of the photosensitive drum 1 to exposure scanning based upon image information, thereby forming an electrostatic latent image. Next, the electrostatic latent image is visualized by toner (developer) contained in a developing unit 4, whereby a toner image, i.e., developer image, is formed on the photosensitive drum 1. Printing paper 16 contained in a paper-feed cassette 8 is fed into the image forming apparatus by a feed roller 9 and the toner image on the photosensitive drum 1 is transferred onto the printing paper 16 by a transfer roller 11 serving as transfer means. The unfixed toner image on the printing paper 16 is fixed on the printing paper 16 by a fixing unit 12 using heat and pressure.

FIG. 17 illustrates the configuration of a developing unit as one example of the developing unit 4 used in the image forming apparatus. In the developing unit 4 shown in FIG. 17, toner 20 is stored in a toner container 100 serving as a toner accommodating unit. By rotating a stirring bar 103, the toner 20 is conveyed to the opening of the toner container 100 located at a developing position where the developing unit 4 and photosensitive drum 1 oppose each other. The opening of the toner container 100 has a developing roller 101, which serves as a developer carrier, for supplying the toner 20 to the electrostatic latent image that has been formed on the photosensitive drum 1. The toner 20 is supplied to the developing roller 101, and toner 20 that has not contributed to development of the electrostatic latent image formed on the photosensitive drum 1 and has been returned to the developing unit 4 is scraped off the developing roller 101 by an RS roller 102, which is placed in contact with the developing roller 101. The developing unit 4 is constructed as a process cartridge removably installed in the main body of the image forming apparatus and is in wide use. Since the image formation described above is carried out using the toner 20, it becomes necessary to prompt the user to replenish the toner 20 when only a small amount of toner is left. Accordingly, the image forming apparatus has a mechanism for detecting remaining amount of toner. This mechanism detects the amount of toner 20 remaining inside the process cartridge, i.e., inside the developing unit 4. A mechanism and method for detecting remaining amount of toner based upon two methods, namely electrostatic capacitance detection and light transmission, will be described below.

FIG. 18 illustrates the configuration of a mechanism for detecting remaining amount of toner based upon electrostatic capacitance detection. An antenna 104 in FIG. 18 is an electrode for detecting remaining amount of toner and is disposed in parallel with the developing roller 101 and spaced a prescribed distance away from the roller. The antenna 104 possesses electrostatic capacitance between itself and the developing roller 101. As the toner 20 inside the toner container 100 is consumed, the toner between the developing roller 101 and antenna 104 decreases. As a result, the dielectric constant between the developing roller 101 and antenna 104 decreases and so does the electrostatic capacitance. By sensing the change in electrostatic capacitance, the amount of toner 20 remaining in the toner container 100 can be detected. In other words, when a prescribed AC voltage is applied to the developing roller 101 by an AC developing high-voltage power supply 105, an AC current value Il conforming to the electrostatic capacitance of an equivalent capacitor 106 formed between the developing roller 101 and antenna 104 is obtained. The AC current value Il is proportional to the product of the frequency and amplitude of the AC developing high-voltage power supply 105 and electrostatic capacitance of the equivalent capacitor 106. The AC current value Il is rectified by a rectifying circuit constructed by diodes 201, 202, resistor 203 and capacitor 204, converted to a voltage value V1 and input to the inverting input terminal of a comparator 108. Similarly, when a prescribed AC voltage is applied to a reference capacitor 107 by the AC developing high-voltage power supply 105, an AC current value 12 conforming to the electrostatic capacitance of the reference capacitor 107 is obtained. The AC current value I2 is rectified by a rectifying circuit constructed by diodes 205, 206, resistor 207 and capacitor 208, converted to a reference voltage value V2 for detecting remaining amount of toner and input to a non-inverting input terminal of the comparator 108. The result of comparison by the comparator 108, i.e., a detection result 110 conforming to the remaining amount of toner, is sent to a controller (not shown) within the image forming apparatus. Based upon the detection result 110, whether the amount of toner 20 remaining inside the toner container 100 is less than a prescribed amount of toner can be detected.

Further, FIG. 19 illustrates the configuration of a mechanism in which the comparison circuit based upon the comparator 108 of FIG. 18 is replaced by an integrating circuit formed by an operational amplifier 109, resistors 209, 210 and capacitor 211. Here the error between the voltages V1, V2 applied to inverting and non-inverting input terminals of the operational amplifier 109 is amplified and detected as the detection result 110. That is, the amount of toner remaining inside the toner container 100 can be detected successively as an analog quantity (see Japanese Patent Application Laid-Open No. 8-44184).

FIG. 20 illustrates the configuration of a mechanism for detecting remaining amount of toner based upon the light transmission method. As shown in FIG. 20, the toner container 100 is provided with transparent windows 401, 402 through which light is transmitted. A photodiode 403 serving as a light-emitting member is provided. A phototransistor 404 serving as a light-receiving member is placed at a position where it will intercept light that has passed through the windows 401, 402 when the light is emitted from the photodiode 403. That is, an optical circuit is formed in such a manner that light emitted from the photodiode 403 passes through the interior of the toner container 100 and is received at the phototransistor 404 situated opposite the photodiode 403. As the toner 20 inside the toner container 100 is consumed, the time it takes for the optical circuit to be formed when the toner is stirred inside the toner container 100 by rotating the stirring bar 103, i.e., the time it takes for light to be transmitted, lengthens. The amount of toner 20 remaining inside the toner container 100 can be detected by sensing a change in the light transmission time. In other words, when light emitted from the photodiode 403 has been sensed, the time it takes for a pulsed voltage waveform that is output from the phototransistor 404 to exceed a preset value is sensed. By sending the sensed time to a controller (not shown), it is possible to sense whether the amount of toner 20 remaining inside the toner container 100 has fallen below a prescribed amount or to sense the remaining amount of toner 20 inside the toner container 100 successively as an analog value (see Japanese Patent Application Laid-Open No. 2000-131936).

Thus, detection of the amount of remaining toner by the electrostatic capacitance detection method is used as a technique ideal for application to a monochrome image forming apparatus having an AC bias power supply for development. Further, the detection of amount of remaining toner by the light transmission method is ideal as a technique for application to a color image forming apparatus that does not use an AC bias power supply for development.

Recently, a developing unit 4 from which the stirring bar 103 has been removed from within the toner container 100 has been proposed for the purpose of reducing the size, weight and cost of the developing unit 4, as illustrated in FIG. 21. However, since the developing unit 4 does not have means for stirring the toner 20 inside the toner container 100, it is difficult to employ the light transmission method in order to detect the remaining amount of toner. In this developing unit 4, therefore, the selection made is detection of remaining amount of toner by the electrostatic capacitance detection method that senses a change in the electrostatic capacitance of the equivalent capacitor 106 formed between the developing roller 101 and RS roller 102.

It should be noted that the RS roller 102 is a member for removing toner from and supplying it to the developing roller 101. In this case, it is required that a color image forming apparatus be provided anew with a special-purpose AC power supply 111 for applying AC voltage to either the developing roller 101 or RS roller 102 only at the time of detection of remaining amount of toner in order to detect the remaining amount of toner by the electrostatic capacitance detection method. Providing the AC power supply 111 raises the cost of the image forming apparatus proper and is a factor that impedes a reduction in the cost of the developing unit 4.

SUMMARY OF THE INVENTION

The present invention has been devised in view of the example of the prior art described above and seeks to provide an image forming apparatus in which remaining amount of toner can be detected without providing a special-purpose power supply for detection of remaining amount of toner and, moreover, in which the electrostatic capacitance detection method is used to perform such detection.

An image forming apparatus according to the present invention comprises: a developer container containing a developer for developing an electrostatic latent image that has been formed on an image carrier; a developer carrier for developing the electrostatic latent image by supplying the image carrier with the developer within the developer container; an electrode member opposing the developer carrier via a space accommodating the developer inside the developer container; a high-voltage power supply having an AC voltage generating circuit for generating AC voltage by switching a DC voltage; a rectifying circuit for rectifying the AC voltage received from the AC voltage generating circuit via a transformer and generating a DC voltage for image formation; and an AC voltage applying unit for applying the AC voltage, which is output from the transformer, to the electrode member; and a developer remaining-amount detection unit for detecting amount of developer remaining inside the developer container based upon electrostatic capacitance between the developer carrier and the electrode member.

In accordance with the present invention, it is possible to provide an image forming apparatus in which remaining amount of toner can be detected without providing a special-purpose power supply for detection of remaining amount of toner and, moreover, in which the electrostatic capacitance detection method is used to perform such detection. As a result, the developing unit can be reduced in size and weight and lowered in cost.

Further features of the present invention will become apparent from the following description of exemplary embodiments with reference to the attached drawings.

DESCRIPTION OF THE EMBODIMENTS

Preferred embodiments of an image forming apparatus according to the present invention will now be described in detail.

First Embodiment

Figure 1:
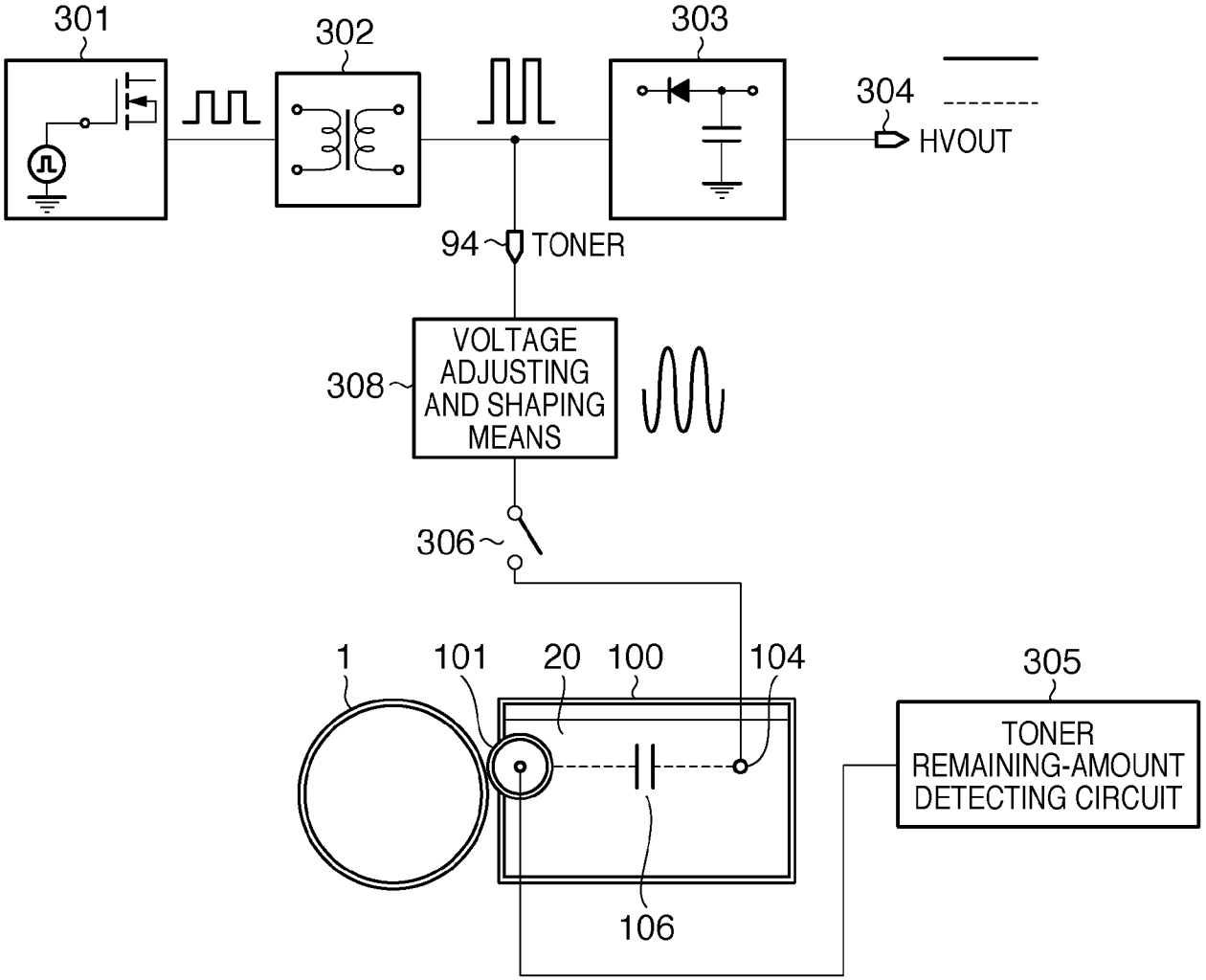
FIG. 1 is a block diagram illustrating a mechanism for detecting remaining amount of toner in a first embodiment of the present invention.

An electrophotographic image forming apparatus according to a first embodiment of the present invention will now be described. FIGS. 1 to 4 are explanatory views of this embodiment. Components having functions identical with those of the prior art described above are designated by like reference characters and need not be described again. FIGS. 1 and 4 differ in that whereas DC bias voltage is applied to the RS roller 102 in FIG. 4, the DC bias voltage is applied to the antenna 104 in FIG. 1. However, there is essentially no difference in that the RS roller 102 of FIG. 4 is used as the antenna 104 in FIG. 1. Further, the electrode that applies the DC bias may be made the developing roller 101 rather than the RS roller 102 or antenna 104. In this case, a circuit 305 for detecting remaining amount of toner is connected to the RS roller 102 or antenna 104. The RS roller 102, photosensitive drum 1 and developing roller 101 are each formed by wrapping a dielectric sheet about a roller made of a conductor such as metal.

This embodiment is an example of an arrangement in which the basic advantages of the present invention are embodied. To achieve this, the apparatus includes a DC high-voltage power supply having an inverter for switching a prescribed DC voltage and supplying an AC voltage to a transformer, and rectifying means for rectifying the output AC voltage of the transformer. The DC high-voltage power supply generates a DC bias for a charging process used in image formation. Further, the apparatus generates an AC bias obtained by turning on the output of the transformer in conformity with a prescribed application timing, and applies the AC bias to one electrode member of a pair of electrodes inside a toner container. The electrodes of the pair are arranged in parallel and spaced apart a prescribed distance. The amount of toner remaining in the toner container is detected by detecting the electrostatic capacitance between the pair of electrodes based upon the difference between a potential detected by the other electrode member of the electrode pair and a potential detected by a reference-capacitance electrode to which the AC bias has been applied. It should be noted that the DC high-voltage power supply is used in a charging step of charging a photosensitive drum in image formation, a developing step of forming a toner image on the photosensitive drum, a transfer step of transferring the toner image that has been formed on the photosensitive drum, and a cleaning step of removing residual toner from the photosensitive drum. The details of this arrangement will now be described with reference to FIGS. 1 to 4.

FIG. 1 is a block diagram illustrating a mechanism for detecting remaining amount of toner by the electrostatic capacitance detection method. This mechanism expresses the characterizing features of the present invention. In FIG. 1, a prescribed DC voltage is converted to an AC voltage by an inverter circuit, which serves as a circuit for generating AC voltage 301, and a transformer 302. The AC voltage is rectified by rectifying means 303, and a DC bias 304 used in each step of image formation is generated. On the other hand, the AC voltage generated by inverter operation is branched off as an AC voltage 94 for detecting remaining amount of toner, and the voltage is adjusted and shaped by voltage adjusting and shaping means 308. This adjusting and shaping of voltage will be described later. The antenna 104 is provided inside the toner container 100 at a position opposing the developing roller 101 via the space that accommodates the toner. The AC voltage 94 for detecting remaining amount of toner is applied to the antenna 104 via a changeover switch 306 at a prescribed timing (application timing). That is, in this embodiment, the changeover switch 306 corresponds to AC bias generating means. The application timing is a period of time other than a time period in which the high-voltage DC power supply is used in order to perform image formation. For example, the application timing may be a period of time during which an image is formed on the photosensitive drum or in which the toner image, i.e., developer image, is transferred to the printing medium, etc.

The circuit 305 for detecting remaining amount of toner is connected to the developing roller 101. As a result, by using the AC voltage 94 for detecting remaining amount of toner, it is possible to detect the remaining amount of toner by the electrostatic capacitance detection method. The antenna 104 and developing roller 101 correspond to electrode members that form a pair of electrodes inside the toner container 100. The circuit 305 for detecting remaining amount of toner has a function for detecting the amount of toner 20 remaining in the toner container 100 by comparing a voltage level, which conforms to a change in electrostatic capacitance of the equivalent capacitor 106, and a prescribed reference voltage level.

The electrode to which the AC voltage 94 for detecting remaining amount of toner is applied may be the developing roller 101 or antenna 104, and the circuit 305 for detecting remaining amount of toner is connected to the electrode to which the AC voltage 94 is not applied. That is, in a case where the AC bias is being applied to one electrode of the electrode pair, the circuit 305 for detecting remaining amount of toner detects the potential at the other electrode member and detects the electrostatic capacitance between the pair of electrodes based upon the difference between the detected potential and the potential obtained from the AC bias mentioned above. The circuit 305 further detects the amount of toner remaining in the toner container 100 from this electrostatic capacitance. The circuit 305 for detecting remaining amount of toner corresponds to means for detecting remaining amount of developer. This embodiment will be described in further detail below.

Figure 2:
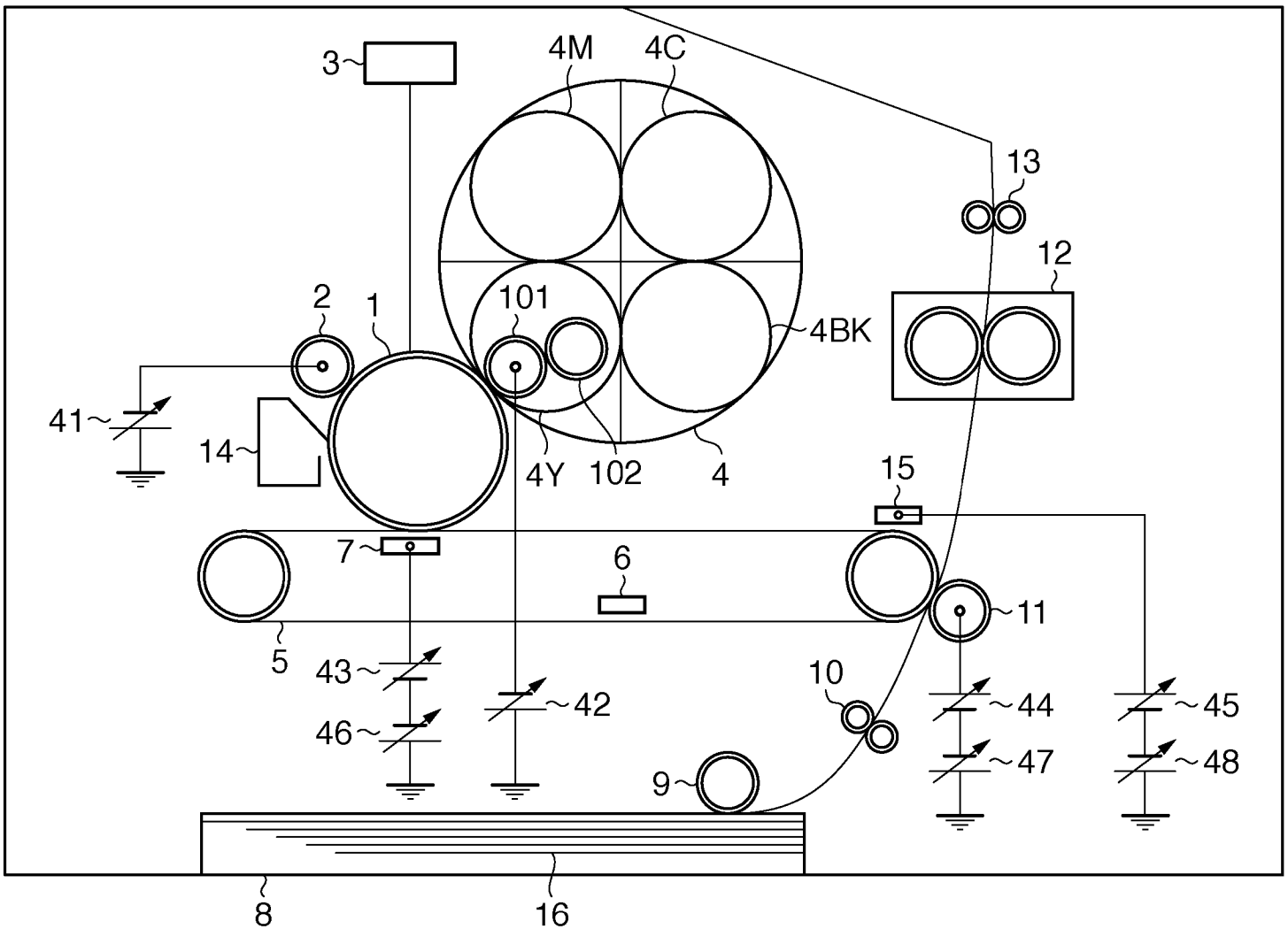
FIG. 2 is a diagram illustrating the configuration of an image forming apparatus according to the first embodiment of the present invention.

FIG. 2 is a diagram illustrating the configuration of an electrophotographic image forming apparatus according to this embodiment. The image forming apparatus has the photosensitive drum 1, which serves as the image carrier, provided at the approximate center thereof. When the image forming operation starts, a charging high-voltage power supply 41 applies a DC negative bias to the charging roller 2 serving as charging means, thereby charging the surface of the photosensitive drum 1 uniformly. Next, a TOP sensor 6 senses an image read/write position, which is decided taking into consideration a transfer position when the toner image on the photosensitive drum 1 is transferred to an intermediate transfer belt 5 serving as an intermediate transfer body. In synch with a TOP signal obtained from the TOP sensor 6 and serving as a reference signal, an exposure unit 3 subjects the surface of the photosensitive drum 1 to exposure scanning by a laser beam modulated based upon the image signal, thereby forming an electrostatic latent image, which corresponds to an image signal of a first color, on the photosensitive drum 1.

The developing unit 4 includes developing devices 4Y, 4M, 4C, 4BK containing toners of the colors yellow, magenta, cyan and black, respectively. The developing unit 4 rotates at a prescribed timing. As a result, each of the developing devices 4Y, 4M, 4C, 4BK is placed at a developing position facing the photosensitive drum 1. Thus, in order to develop the electrostatic latent image of the first color, the yellow developing device 4Y is placed at the developing position facing the photosensitive drum 1 and a developing high-voltage power supply 42 applies DC negative bias to the developing roller 101. Accordingly, the developing roller 101 is placed so as to oppose the photosensitive drum 1 serving as the image carrier and corresponds to a developer carrier for carrying and transporting the developer contained in the toner container, i.e., developer container. By virtue of this operation, the yellow (first-color) toner image is visualized and formed on the photosensitive drum 1. Thereafter, a primary-transfer high-voltage power supply 43 applies DC positive bias, the polarity of which is opposite that of the toner, to a belt transfer member 7 provided at a position opposing the intermediate transfer belt 5, thereby primarily transferring the yellow toner image on the photosensitive drum 1 to the intermediate transfer belt 5. By repeating steps similar to the foregoing with regard to the magenta developing device 4M, cyan developing device 4C and black developing device 4BK for the second, third and fourth colors, respectively, a full-color toner image is formed on the intermediate transfer belt 5.

Next, printing paper 16 contained in the paper-feed cassette 8 is fed up to a registration roller pair 10 by the feed roller 9 at a prescribed timing that is based upon the TOP signal. Here the printing paper 16 stops temporarily. The printing paper 16 is fed again from the registration roller pair 10 in synch with prescribed transfer timing. Next, a secondary-transfer high-voltage power supply 44 applies DC positive bias to the transfer roller 11, which serves as transfer means, whereby the full-color toner image on the intermediate transfer belt 5 is transferred in total to the printing paper 16 (this transfer is referred to as "secondary transfer"). Thereafter, the unfixed full-color toner image on the printing paper 16 is fixed on the printing paper 16 by a fixing unit 12 using heat and pressure. The printing paper 16 is then ejected to the exterior of the image forming apparatus by a conveyance roller pair 13. Primary-transfer residual toner and the like remaining on the photosensitive drum 1 after the primary transfer of each color to the intermediate transfer belt 5 is completed is removed and recovered in a residual-toner collection unit 14 comprising a blade-shaped cleaning member. Similarly, secondary-transfer residual toner not transferred to the printing paper 16 upon completion of secondary transfer remains on the intermediate transfer belt 5. Before this secondary-transfer residual toner arrives at the photosensitive drum 1, a belt-cleaning high-voltage power supply 45 applies DC positive bias (referred to as "cleaning bias") to a belt cleaning unit 15, thereby charging it to a positive polarity. In the secondary-transfer residual toner, toner charged to negative polarity is recovered by the belt cleaning unit 15. On the other hand, secondary-transfer residual toner that has been charged to positive polarity is transferred electrostatically to the photosensitive drum 1 as a result of the primary-transfer high-voltage power supply 43 applying a positive bias, the polarity of which is the same as that of the secondary-transfer residual toner, and the toner is removed and recovered in the residual-toner collection unit 14. By performing such belt cleaning immediately after secondary transfer, image formation can be executed repeatedly. The series of image forming operations described above is referred to as an image formation sequence below.

Further, at power-supply start-up, a secondary-transfer reverse high-voltage power supply 47 and belt-cleaning reverse high-voltage power supply 48 apply DC negative biases to the transfer roller 11 and belt cleaning unit 15, respectively, at a prescribed timing, such as after the printing of a prescribed number of pages or after the detection of jamming. Secondary-transfer residual toner, etc., remaining on the transfer roller 11 or belt cleaning unit 15 is charged to negative polarity and returned temporarily to the intermediate transfer belt 5. As a result of a primary-transfer reverse high-voltage power supply 46 applying negative bias of the same polarity as the secondary-transfer residual toner, the secondary-transfer residual toner that has been charged to the negative polarity is transferred electrostatically to the photosensitive drum 1, and the toner is removed and recovered in the residual-toner collection unit 14. This operation of removing the secondary-transfer residual toner and recovering it in the residual-toner collection unit 14 via the intermediate transfer belt 5 and photosensitive drum 1 is referred to as a cleaning sequence below.

Thus, in the electrophotographic image forming apparatus, as described above, a high-voltage power supply for generating DC bias is provided and is used at each step of a series of electrophotographic process steps.

Figure 3:
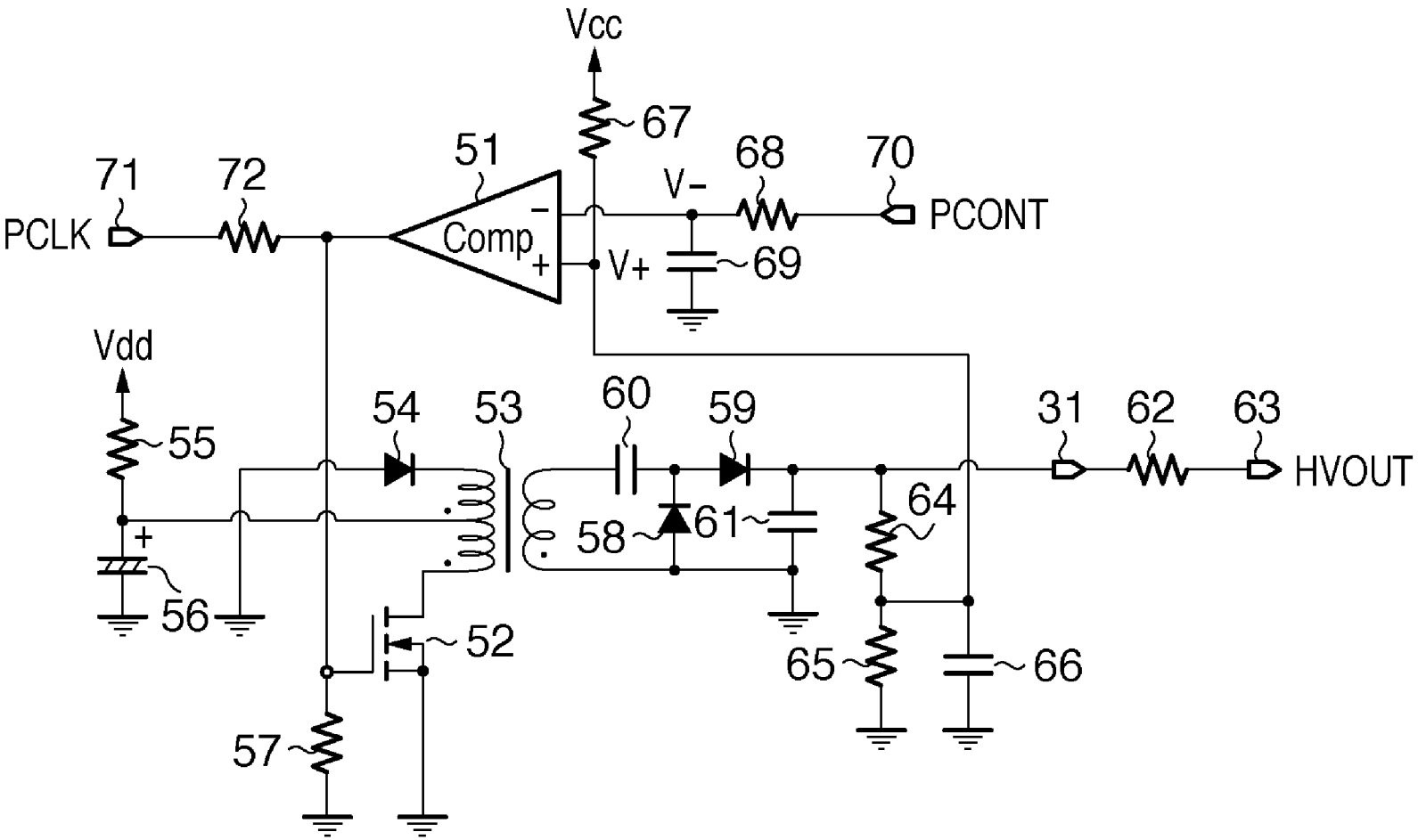
FIG. 3 is a diagram illustrating the circuit configuration of a high-voltage power supply of the image forming apparatus according to the first embodiment of the present invention.
Figure 4:
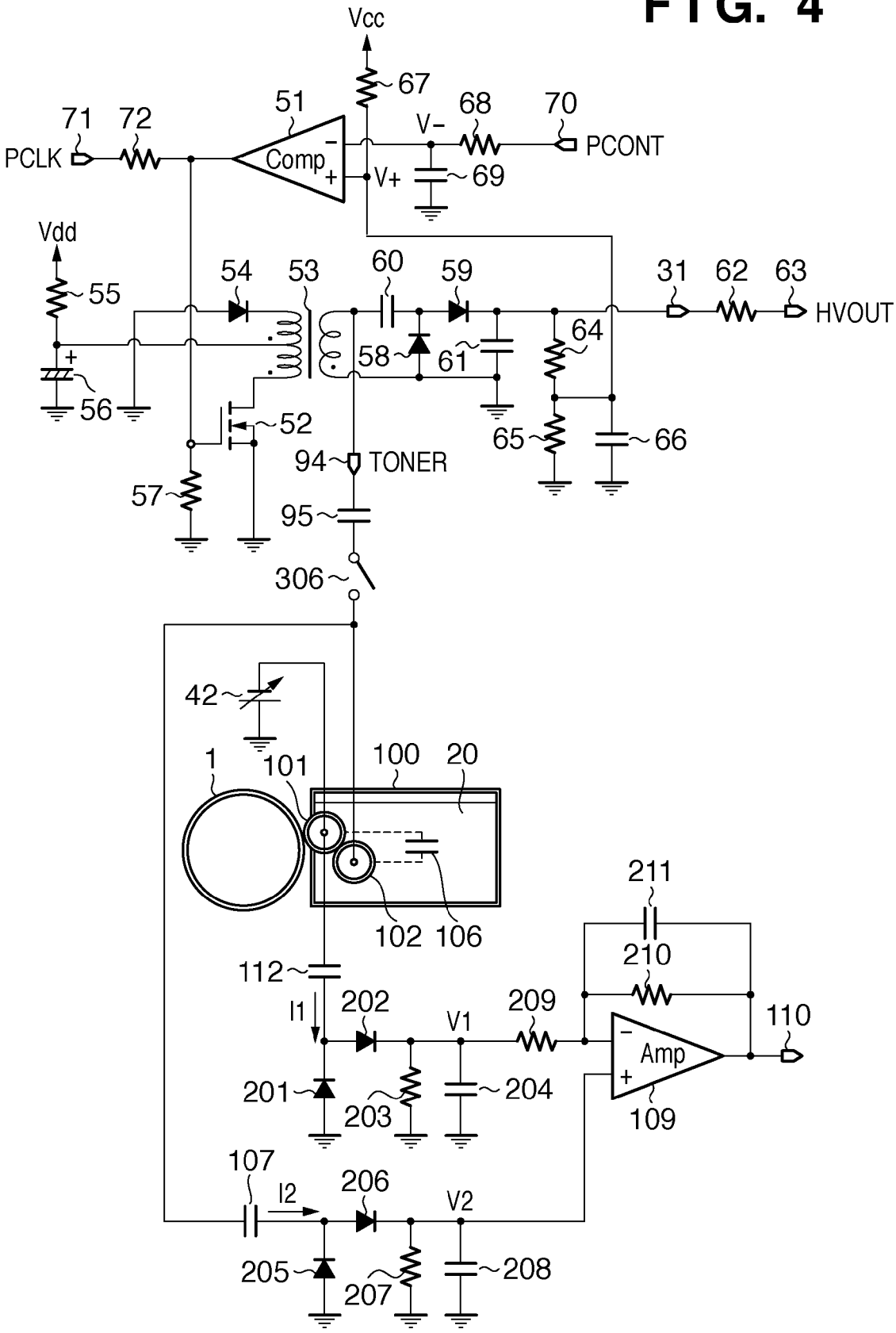
FIG. 4 is a diagram illustrating a mechanism for detecting remaining amount of toner in the first embodiment of the present invention.

FIG. 3 is a diagram illustrating the circuit configuration of a high-voltage power supply of the image forming apparatus. The high-voltage supply shown in FIG. 3 is an example of a DC positive bias power supply for generating a DC positive bias. In FIG. 3, a comparator 51 compares an analog voltage V+ that is input to a non-inverting input terminal and an analog voltage V− that is input to an inverting input terminal. The comparator 51 has such a characteristic that the comparator output terminal is made an open collector if V+>V− holds and is grounded if V+<V− holds. A FET 52 has a drain terminal connected to a primary winding of a high-voltage transformer 53, and a source terminal connected to ground. Another primary winding of the high-voltage transformer 53 is connected to ground via a diode 54, thereby forming a snapper circuit. One other primary winding of the high-voltage transformer 53 is connected to a DC power supply voltage Vdd via a resistor 55. An electrolytic capacitor 56 is a decoupling capacitor for rendering constant the primary-coil application voltage of the high-voltage transformer 53. The FET 52 has a gate terminal connected to the comparator output terminal of the comparator 51. A gate signal, described later, is input to the gate terminal and switchingly drives the primary windings of the high-voltage transformer 53. A resistor 57 connected between the gate terminal of the FET 52 and ground is a resistor for dealing with static electricity with respect to the gate terminal of the FET 52. By thus switchingly driving the primary windings of the high-voltage transformer 53, AC high voltage is generated in the secondary winding of the high-voltage transformer 53.

This AC high voltage is voltage-doubled by a rectifying circuit composed of diodes 58, 59 and capacitors 60, 61, whereby a DC high voltage, i.e., a DC positive bias 31, is generated. The DC positive bias 31 is output as signal HVOUT to a DC high-voltage output terminal 63 via an output resistor 62. The DC positive bias 31 is input to the non-inverting input terminal of the comparator 51 via a feedback circuit composed of output-voltage detection resistors 64, 65 and a capacitor 66. The non-inverting input terminal is pull-up connected to a DC power supply voltage Vcc via a resistor 67, and the arrangement is such that the analog voltage V+ is varied in accordance with the absolute value of the DC positive bias 31. An RC filter composed of a resistor 68 and capacitor 69 generates the analog voltage V−, which conforms to a DC positive bias output adjustment signal (PCONT) 70 sent from a controller (not shown) within the image forming apparatus. The analog voltage V− is input to the inverting input terminal of the comparator 51. The comparator 51 compares the magnitudes of the analog voltages V+, V− that have been input to the respective input terminals and controls the state of the comparator output terminal.

A terminal for outputting a clock signal (PCLK) 71 sent from the controller (not shown) within the image forming apparatus is connected via a resistor 72 to the comparator output terminal of the comparator 72 and to the gate terminal of the FET 52. In accordance with the result of comparison by the comparator 51, the clock signal 71 is masked on the downstream side of the resistor 72 and becomes a gate signal that switchingly operates the FET 52. That is, in a case where the comparator output terminal is an open collector, the clock signal 71 is transmitted to the gate terminal of the FET 52 and the FET 52 is driven. On the other hand, in a case where the comparator output terminal is grounded, the clock signal 71 is not transmitted to the gate terminal of the FET 52 and the FET 52 is held in the off state. Thus, a circuit is constructed in which the DC output voltage is subjected to constant-voltage control by controlling the clock signal 71, which drives the high-voltage transformer 53, using the comparator 51.

Detection of remaining amount of toner by the electrostatic capacitance detection method in the image forming apparatus of this embodiment will be described next. Detection of remaining amount of toner by the electrostatic capacitance detection method requires AC bias. Whereas the image forming apparatus of this embodiment has a high-voltage power supply for generating DC bias, it is not equipped with a high-voltage power supply for generating AC bias. However, the DC bias is generated by using the rectifying circuit to rectify the AC high voltage generated in the secondary winding of the high-voltage transformer 53. Accordingly, detection of remaining amount of toner by the electrostatic capacitance detection method is performed by generating the AC bias for detection of remaining amount of toner from the AC voltage component prior to rectification by the rectifying circuit and applying this AC bias to the developing roller 101 or RS roller 102 within the developing unit 4. In this embodiment, the AC bias is applied to the RS roller 102.

The high-voltage power supply used at the time of the image formation sequence can be utilized as the high-voltage power supply that generates the AC bias for detecting remaining amount of toner. That is, the charging high-voltage power supply 41, developing high-voltage power supply 42, primary-transfer high-voltage power supply 43, secondary-transfer high-voltage power supply 44 and belt-cleaning high-voltage power supply 45 can be utilized as the high-voltage power supply. In a case where the AC bias for detecting remaining amount of toner has been generated from these power supplies, there is the danger that AC voltage will be applied to the developing roller 101 or RS roller 102 in the developing step of image formation and cause faulty development. Accordingly, in a case where the AC bias for detecting remaining amount of toner is generated from the AC high voltage generated in the secondary winding of high-voltage transformer in these power supplies, it will suffice to provide a mechanism in which AC voltage is not applied to the developing roller 101 or RS roller 102 in the developing step of image formation.

FIG. 4 illustrates a mechanism for detecting remaining amount of toner by the electrostatic capacitance detection method according to this embodiment. As shown in FIG. 4, the AC high voltage generated in the secondary winding of the high-voltage transformer 53 by switchingly driving the primary windings of the high-voltage transformer 53 is branched off as the AC voltage 94 for detecting remaining amount of toner. The changeover switch 306 is turned OFF at the time of execution of the image formation sequence and is turned ON at the time of detection of remaining amount of toner, which is other than the time of the image formation sequence. When the changeover switch 306 has been turned ON, therefore, the AC voltage 94 for detecting amount of remaining toner is applied to the RS roller 102 via a coupling capacitor 95. The coupling capacitor 95 is used as the voltage adjusting and shaping means (308 in FIG. 1) for removing the DC voltage component of the AC voltage 94 for detecting amount of remaining toner. The amount of toner 20 remaining inside the toner container 100 is detected by detecting the change in electrostatic capacitance of the equivalent capacitor 106 formed between the electrode pair composed of the RS roller 102 and developing roller 101. Further, a coupling capacitor 112 is used in order to remove the DC voltage component in such a manner that the DC negative bias applied to the developing roller 101 by the developing high-voltage power supply 42 will not be impressed upon the side of the circuit that detects remaining amount of toner.

Although the high-voltage power supply in FIG. 4 is a DC positive bias power supply for generating DC positive bias, a DC negative bias power supply may be used instead of this high-voltage power supply. That is, any high-voltage power supply among the charging high-voltage power supply 41, developing high-voltage power supply 42, primary-transfer high-voltage power supply 43, secondary-transfer high-voltage power supply 44 and belt-cleaning high-voltage power supply 45 may be used. In other words, the high-voltage power supply used at the time of execution of the image formation sequence can be used as the high-voltage voltage power supply for generating the AC bias for detecting remaining amount of toner.

Thus, as described above, a DC high-voltage power supply used in image formation is composed of an inverter and rectifier. Further, the image forming apparatus is provided with voltage adjusting and rectifying means for branching off the output AC voltage of the inverter, i.e., the switching voltage prior to rectification, and forming an approximate sine wave of a prescribed accuracy, and switching means for applying the output of the voltage adjusting and rectifying means to the developing unit at a prescribed timing. As a result, AC bias means for detecting remaining amount of toner by the electrostatic capacitance detection method is formed. By using the arrangement described above, detection of remaining amount of toner by the electrostatic capacitance detection method can be performed with a low-cost configuration without provision anew of a special-purpose AC power supply.

It should be noted that the arrangement described in this embodiment can be modified appropriately so long as the modified arrangement is equivalent, and that the scope of the present invention is not limited solely to the arrangement illustrated.

Second Embodiment

Figure 5:
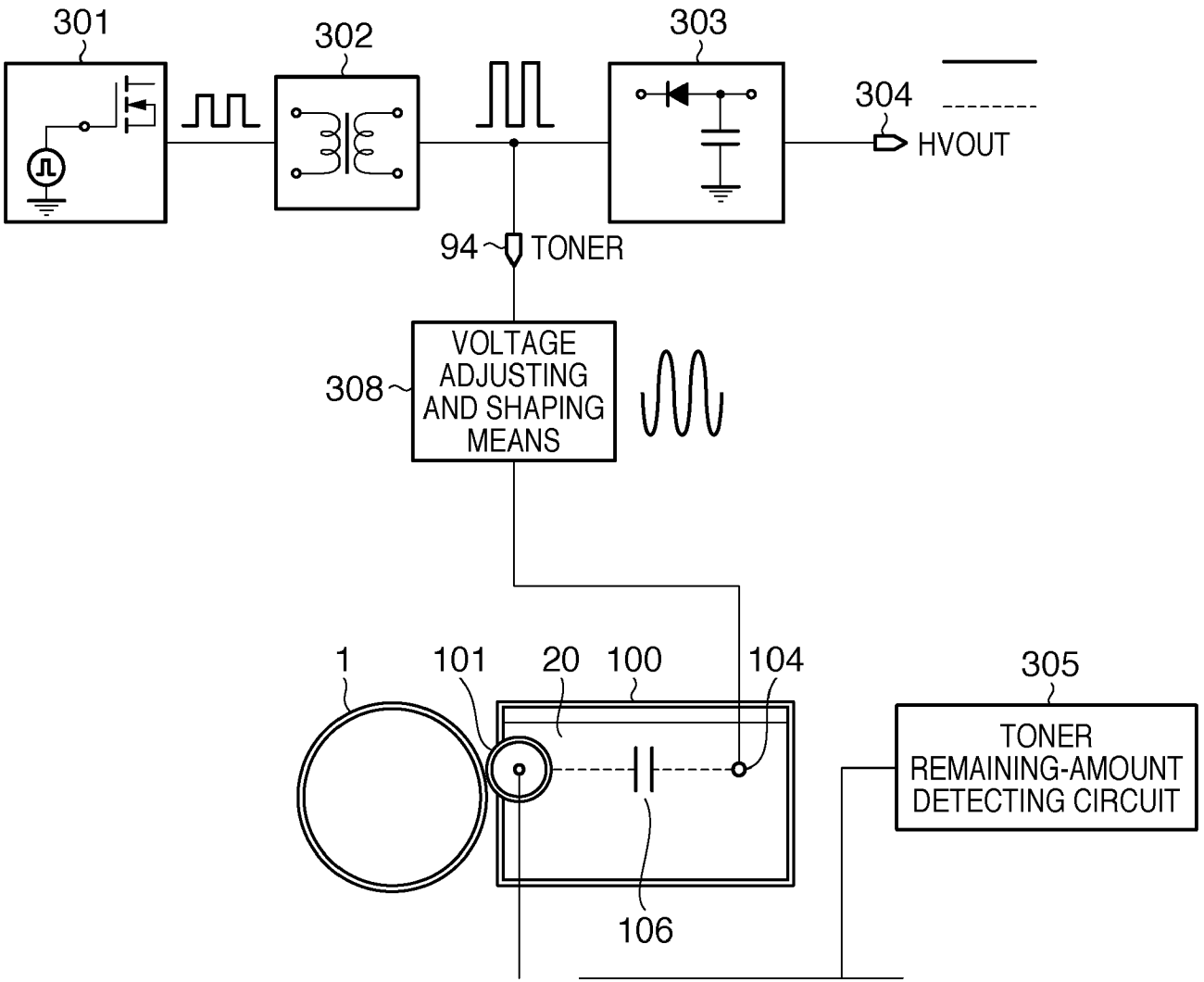
FIG. 5 is a block diagram illustrating a mechanism for detecting remaining amount of toner in a second embodiment of the present invention.
Figure 6:
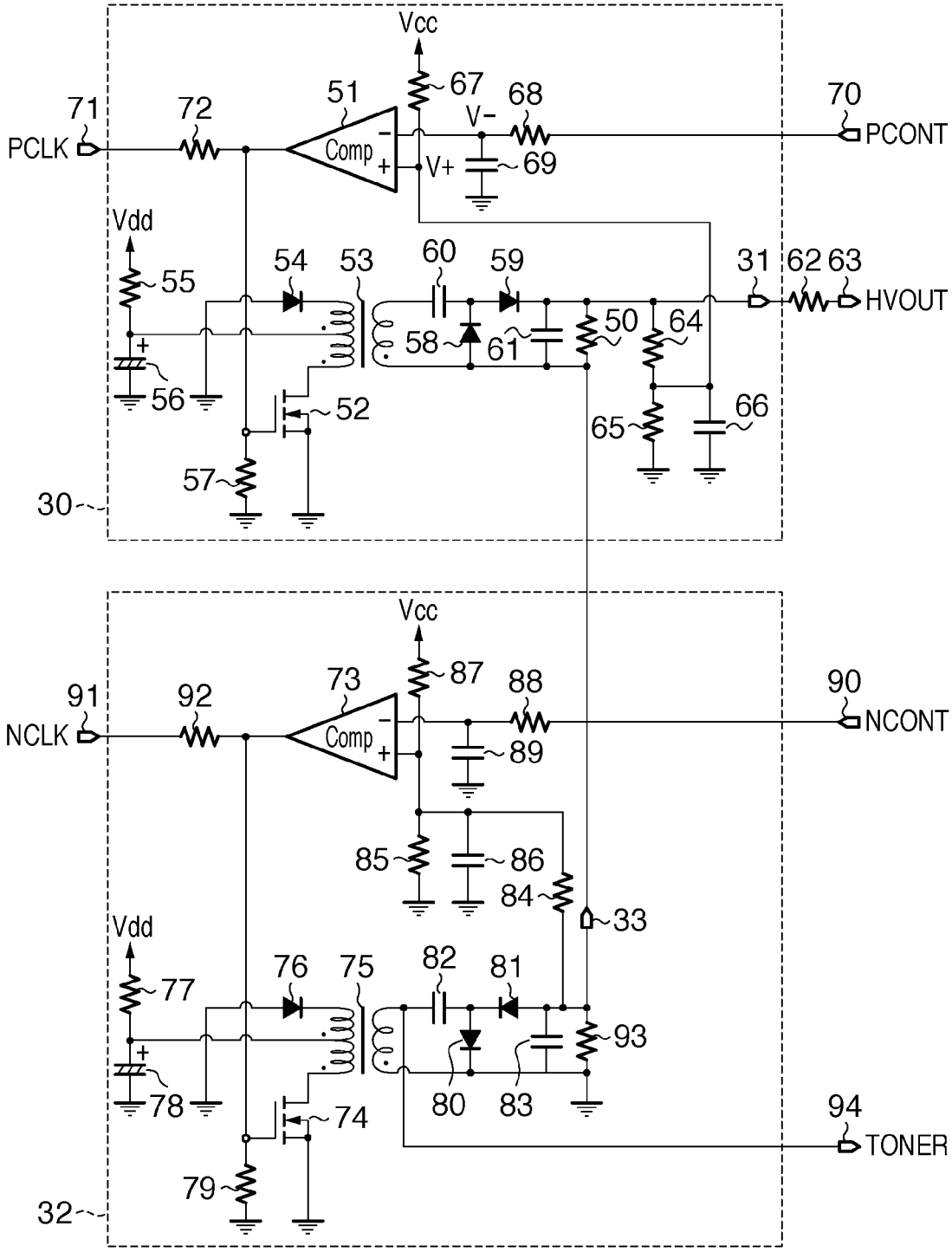
FIG. 6 is a diagram illustrating the circuit configuration of a high-voltage power supply of the image forming apparatus according to the second embodiment of the present invention.
Figure 7:
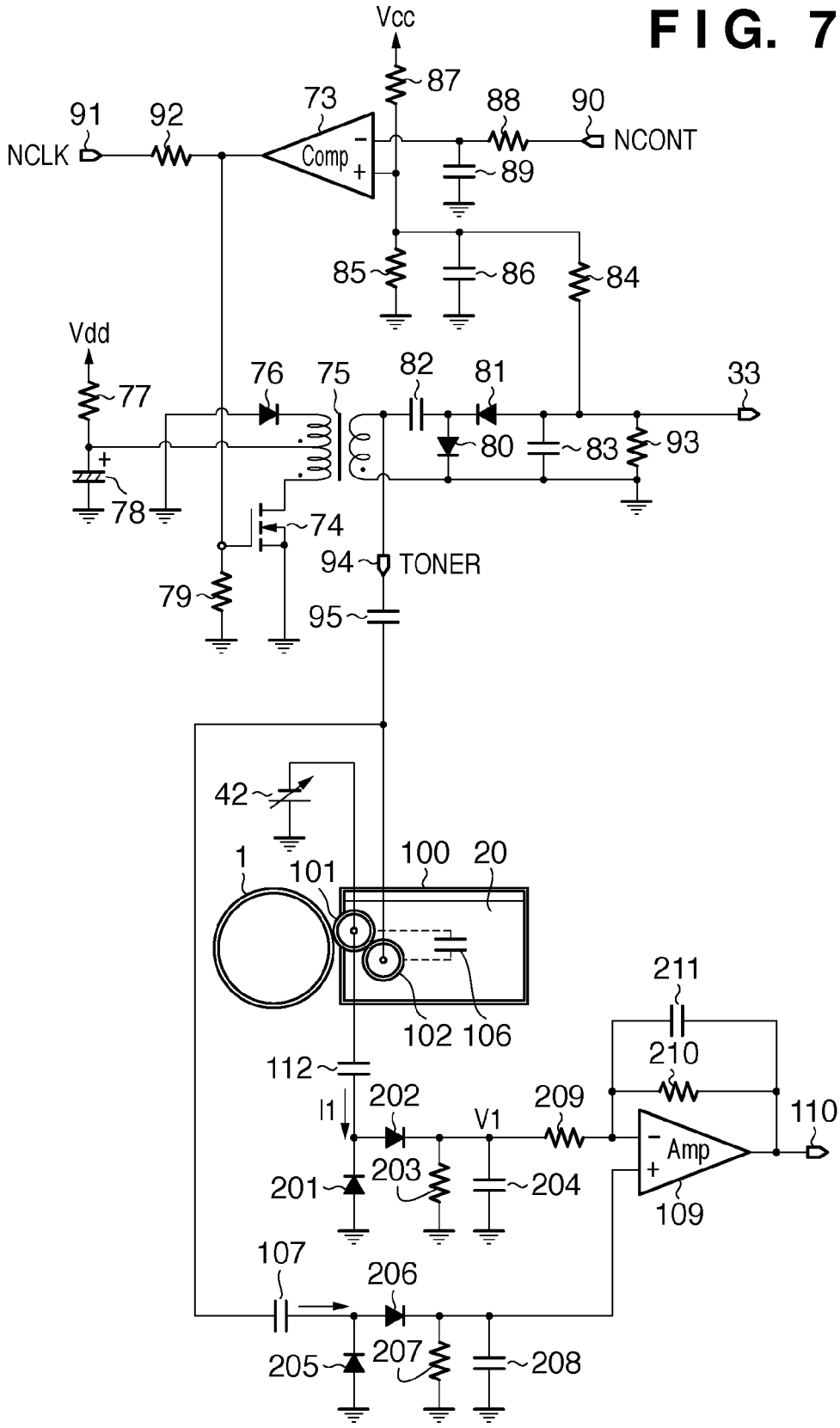
FIG. 7 is a diagram illustrating a mechanism for detecting remaining amount of toner in the second embodiment of the present invention.

A second embodiment of the present invention will now be described. FIGS. 5 to 7 are explanatory views of this embodiment. Components having functions identical with those of the prior art and the first embodiment described above are designated by like reference characters and need not be described again. The characterizing feature of this embodiment resides in the fact that AC bias means for detecting remaining amount of toner by the electrostatic capacitance detection method is formed by providing voltage adjusting and shaping means for branching off switching voltage prior to rectification of DC high voltage used when image formation is not carried out, and forming an approximate sine wave of a prescribed accuracy. Here a high-voltage power supply used particularly at the time of the cleaning sequence as the high-voltage power supply employed when image formation is not carried out will be described as an example. The details of this arrangement will be described below with reference to FIGS. 5 to 7.

FIG. 5 is a block diagram illustrating a mechanism for detecting remaining amount of toner by the electrostatic capacitance detection method of this embodiment. If the high-voltage power supply used at the time of the cleaning sequence is employed as the high-voltage power supply for generating the AC voltage 94 for detecting remaining amount of toner, then the remaining amount of toner can be detected by the electrostatic capacitance detection method without providing the changeover switch 306 of FIG. 1. This embodiment will be described below in detail.

This embodiment uses the high-voltage power supply employed at the time of the cleaning sequence instead of the high-voltage power supply used at the time of image formation sequence, as the high-voltage power supply for generating the AC voltage 94 for detecting remaining amount of toner in the first embodiment. That is, the primary-transfer reverse high-voltage power supply 46, secondary-transfer reverse high-voltage power supply 47 and belt-cleaning reverse high-voltage power supply 48 are used. Since these power supplies are high-voltage power supplies that operate at the time of the cleaning sequence, AC voltage for detecting remaining amount of toner is not applied to the developing roller 101 or RS roller 102 at the time of the image formation sequence. Accordingly, the AC high voltage generated in the secondary winding of the high-voltage transformer in these power supplies can be used as the AC voltage 94 for detecting remaining amount of toner without providing the changeover switch 306 of the first embodiment. That is, the changeover switch 306 is not applicable to AC bias generating means; rather, a controller (not shown) for controlling AC-voltage generation per se corresponds to the AC bias generating means.

FIG. 6 illustrates the circuit configuration of the high-voltage power supply of the image forming apparatus taking the belt-cleaning high-voltage power supply 45 and belt-cleaning reverse high-voltage power supply 48 as examples. In FIG. 6, the belt-cleaning high-voltage power supply 45 and belt-cleaning reverse high-voltage power supply 48 comprise a circuit obtained by serially connecting a DC positive bias power supply 30 and a DC negative bias power supply 32 via bleeder resistors 50, 93. The DC positive bias power supply 30 operates in a manner similar to the circuit described in the first embodiment. With regard to the DC negative bias power supply 32, on the other hand, this differs from the DC positive bias power supply 30 only in the polarities of a DC negative bias adjustment signal (NCONT) 90, clock signal (NCLK) 91 and rectifying circuit composed of diodes 80, 81 and capacitors 82, 83.

FIG. 7 illustrates a mechanism for detecting remaining amount of toner by the electrostatic capacitance detection method according to this embodiment. As shown in FIG. 7, AC high voltage generated in the secondary winding of a high-voltage transformer 75 by switchingly driving the primary windings of a high-voltage transformer 75 is detected as the AC voltage (indicated by the signal TONER in FIG. 7) 94 for detecting remaining amount of toner. The AC voltage 94 for detecting remaining amount of toner is applied to the RS roller 102 via the coupling capacitor 95, and a change in the electrostatic capacitance of the equivalent capacitor 106 formed between the RS roller 102 and developing roller 101 is detected. In a manner similar to the first embodiment, the coupling capacitor 95 is used as the voltage adjusting and shaping means (308 in FIG. 5) in order to remove the DC voltage component of the AC voltage 94 for detecting remaining amount of toner. The amount of toner 20 remaining inside the toner container 100 is thus detected. That is, the AC voltage 94 for detecting remaining amount of toner shown in FIG. 6 corresponds to the AC voltage 94 for detecting remaining amount of toner in FIG. 4. Although the voltage 94 is connected to the RS roller 102 via the changeover switch 306 in FIG. 4, the changeover switch 306 is eliminated in this embodiment.

Although the belt-cleaning reverse high-voltage power supply 48 is mentioned as an example of the high-voltage power supply shown in FIG. 7, the primary-transfer reverse high-voltage power supply 46 and secondary-transfer reverse high-voltage power supply 47 may be used instead of the belt-cleaning reverse high-voltage power supply 48. In other words, it will suffice if a high-voltage power supply used at the time of the cleaning sequence is employed as the high-voltage power supply that generates the AC bias for detecting remaining amount of toner.

Thus, by providing voltage adjusting and shaping means for branching off switching voltage prior to rectification of DC high voltage used when image formation is not carried out and forming an approximate sine wave of a prescribed accuracy, AC bias for detecting remaining amount of toner by the electrostatic capacitance detection method is generated. Here a high-voltage power supply used particularly at the time of the cleaning sequence is adopted as the high-voltage power supply employed when image formation is not carried out. By using this arrangement, it is unnecessary to provide the changeover switch 306 and remaining amount of toner can be detected by the electrostatic capacitance detection method with an arrangement of lower cost in comparison with the first embodiment.

It should be noted that the arrangement described in this embodiment can be modified appropriately so long as the modified arrangement is equivalent, and that the scope of the present invention is not limited solely to the arrangement illustrated.

Third Embodiment

A third embodiment of the present invention will now be described. Components having functions identical with those of the prior art and the foregoing embodiments described above are designated by like reference characters and need not be described again. The characterizing feature of this embodiment resides in the fact that AC bias for detecting remaining amount of toner is applied not only to the RS roller 102 but also to the developing roller 101 or antenna 104. This embodiment differs from the foregoing embodiments only in this respect.

Figure 8:
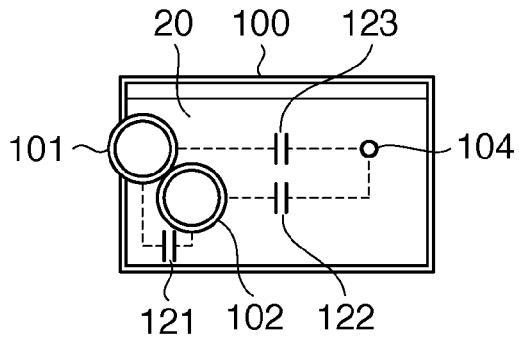
FIG. 8 is a diagram illustrating the configuration of a developing unit according to a third embodiment of the present invention.

FIG. 8 illustrates the configuration of a developing unit according to this embodiment. As for the member to which the AC voltage 94 for detecting remaining amount of toner is applied, an electrode pair is arranged inside the toner container 100 and it will suffice if the electrostatic capacitance of the equivalent capacitor 106 decreases in accordance with a change in amount of toner inside the toner container 100. That is, the AC voltage 94 for detecting remaining amount of toner may be applied to any one of the developing roller 101, RS roller 102 and antenna 104. It will suffice to detect a change in the electrostatic capacitance of any of an equivalent capacitor 121 between the developing roller 101 and RS roller 102, an equivalent capacitor 122 between the RS roller 102 and antenna 104 and an equivalent capacitor 123 between the developing roller 101 and antenna 104. In particular, the remaining amount of toner can be detected with excellent accuracy if the AC voltage 94 for detecting remaining amount of toner is applied to the RS roller 102 or antenna 104 and a change in the electrostatic capacitance of the equivalent capacitor 121 between the developing roller 101 and RS roller 102 or of the equivalent capacitor 123 between the developing roller 101 and antenna 104 is detected. Further, this embodiment is applicable not only to a developing unit from which the stirring bar 103 in toner container 100 is eliminated but also to a developing unit having the stirring bar 103.

By virtue of the arrangement described above, it is possible to enhance the degree of freedom of a method of establishing a mechanism for detecting remaining amount of toner by the electrostatic capacitance detection method.

It should be noted that the arrangement described in this embodiment can be modified appropriately so long as the modified arrangement is equivalent, and that the scope of the present invention is not limited solely to the arrangement illustrated.

Fourth Embodiment

Figure 9:
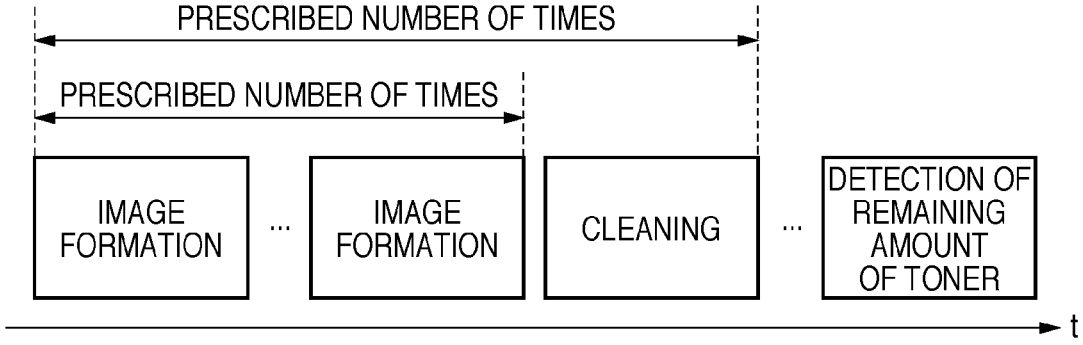
FIG. 9 is a diagram illustrating the operating sequence of an image forming apparatus according to the prior art.
Figure 10:
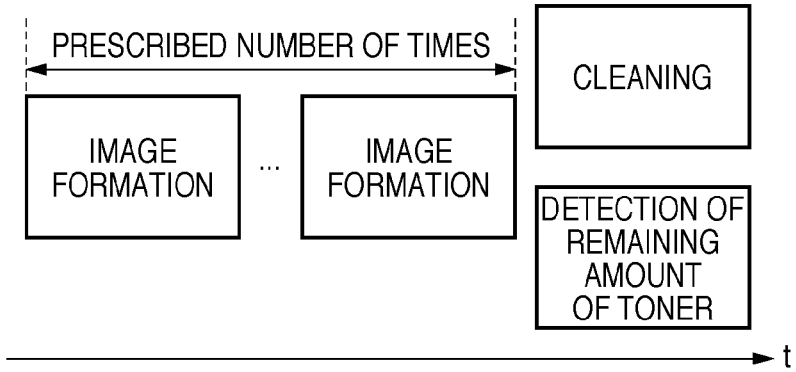
FIG. 10 is a diagram illustrating the operating sequence of an image forming apparatus according to a fourth embodiment of the present invention.

A fourth embodiment of the present invention will now be described. FIGS. 9 and 10 are explanatory views of this embodiment. Components having functions identical with those of the prior art and foregoing embodiments described above are designated by like reference characters and need not be described again. In a manner similar to the second embodiment, the characterizing feature of this embodiment resides in the fact that AC bias for detecting remaining amount of toner is applied at the time of the cleaning sequence, thereby shortening the time for detecting remaining amount of toner. This arrangement is possible in a case where the high-voltage power supply that operates at the time of the cleaning sequence is used as the high-voltage power supply that generates the AC bias for detecting remaining amount of toner. The details of this embodiment will be described in detail below.

FIG. 9 illustrates the operating sequence of an image forming apparatus according to the prior art. As shown in FIG. 9, cleaning is carried out after image formation has been performed a prescribed number of times. Then, after a sequence comprising such image formation and cleaning has been performed a prescribed number of times, the remaining amount of toner is detected. In a case where a sequence for detecting remaining amount of toner is thus provided independently, time is wasted.

FIG. 10 illustrates the operating sequence of the image forming apparatus according to this embodiment. In a case where the high-voltage power supply that operates at the time of the cleaning sequence is used as the high-voltage power supply that generates the AC voltage 94 for detecting remaining amount of toner, cleaning and detection of remaining amount of toner can be performed simultaneously. Accordingly, a sequence for detecting remaining amount of toner is not provided independently, thereby allowing the required time to be shortened correspondingly.

Thus, by applying AC bias for detection of remaining amount of toner at the timing of the cleaning sequence, the time needed to detect remaining amount of toner can be shortened.

It should be noted that the arrangement described in this embodiment can be modified appropriately so long as the modified arrangement is equivalent, and that the scope of the present invention is not limited solely to the arrangement illustrated.

Fifth Embodiment

A fifth embodiment of the present invention will now be described. FIGS. 11 to 15 are explanatory views of this embodiment. Components having functions identical with those of the prior art and foregoing embodiments described above are designated by like reference characters and need not be described again. The characterizing feature of this embodiment is premised upon the arrangement of the second embodiment and resides in the fact that AC bias for detecting remaining amount of toner is applied at a timing different from that of the cleaning sequence and the inverter driving frequency or duty ratio is changed over to a prescribed driving frequency or duty ratio. Furthermore, by constructing the voltage adjusting and adjusting means as means having the function of a transformer or low-pass filter, the AC bias for detecting remaining amount of toner is made an approximate sine wave and the accuracy with which the remaining amount of toner is detected is improved. The details of this arrangement will be described with reference to FIGS. 11 to 15.

Figure 11:
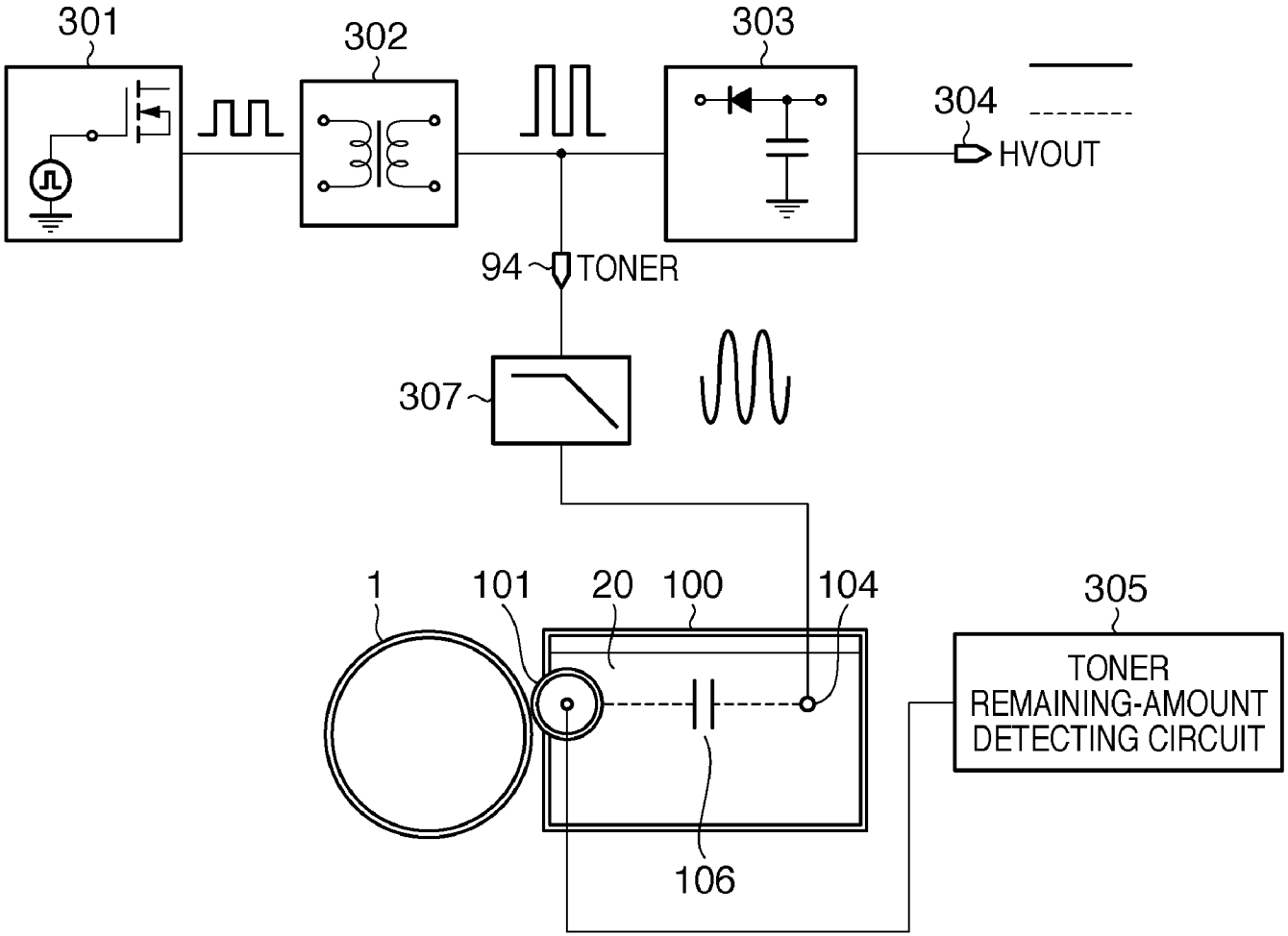
FIG. 11 is a block diagram illustrating a mechanism for detecting remaining amount of toner in a fifth embodiment of the present invention.

FIG. 11 is a block diagram illustrating a mechanism for detecting remaining amount of toner by the electrostatic capacitance detection method according to this embodiment. In FIG. 11, the driving frequency or duty ratio of inverting means 301 is changed over to a prescribed condition at the time of detection of remaining amount of toner. Further, a low-pass filter 307 reduces the high-frequency components of the AC voltage 94 for detecting remaining amount of toner and provides an approximate sine wave having a single frequency component. The remaining amount of toner is detected more accurately using this arrangement. The embodiment will be described below in detail.

In FIG. 7, the AC current value I1 conforming to the electrostatic capacitance of the equivalent capacitor 106 formed between the RS roller 102 and developing roller 101 is expressed by Equation 1 below, where f represents the frequency of the AC voltage 94 for detecting remaining amount of toner, Vpp represents the amplitude value and Ct is the electrostatic capacitance of the equivalent capacitor.

$$I1=2\pi f\cdot Vpp\cdot Ct \quad \text{(Equation 1)}$$

Similarly, the AC current value I2 conforming to the electrostatic capacitance of the reference capacitor 107 is expressed by Equation 2 below, where Cref is the electrostatic capacitance of the reference capacitor.

$$I2=2\pi f\cdot Vpp\cdot Cref \quad \text{(Equation 2)}$$

In general, the electrostatic capacitance Ct of the equivalent capacitor and the electrostatic capacitance Cref of the reference capacitor have different frequency characteristics. Accordingly, in order to compare the electrostatic capacitances in excellent fashion by comparing I1 and I2, it is necessary that the frequency f and amplitude value Vpp of the AC voltage 94 for detecting remaining amount of toner be held at constant values in Equations 1 and 2.

Figure 12:
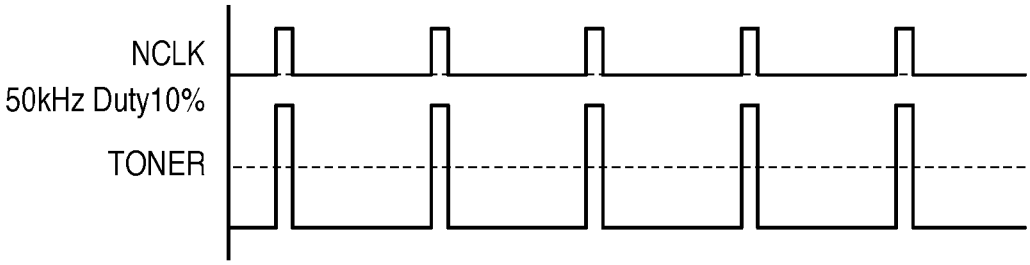
FIG. 12 is a diagram illustrating waveforms associated with AC voltage for detecting remaining amount of toner in the fifth embodiment of the present invention.

Next, the waveform of the AC voltage 94 for detecting remaining amount of toner will be considered. In FIG. 7, the circuit arrangement is such that the primary windings of the high-voltage transformer 75 are switchingly driven by the clock signal 91 of frequency 50 kHz and duty ratio 10%, whereby DC negative bias 33 is obtained. The reason for selecting 10% as the duty ratio is to drive the high-voltage transformer 75 highly efficiently and obtain the desired output characteristic of high-voltage bias 33. The waveform of the AC voltage 94 for detecting remaining amount of toner in this case is as illustrated in FIG. 12. The AC voltage 94 shown in FIG. 12 is an asymmetrical square wave containing many higher harmonic components. In a case where the AC voltage 94 for detecting remaining amount of toner is used to detect remaining amount of toner, there is the danger that a large number of values of frequency f in Equations 1 and 2 will exist and that the accuracy of comparison of current values to be detected will decline.

Accordingly, in this embodiment, the high-voltage power supply that operates at the time of the cleaning sequence is used as the high-voltage power supply for generating the AC voltage 94 for detecting remaining amount of toner, and detection of remaining amount of toner is performed at a timing different from that of the cleaning sequence. In other words, when remaining amount of toner is detected, the higher harmonic components of the AC voltage 94 for detecting remaining amount of toner are reduced by suitably changing the frequency or duty ratio of the clock signal 91 that drives the primary windings of the high-voltage transformer 75.

Figure 13:
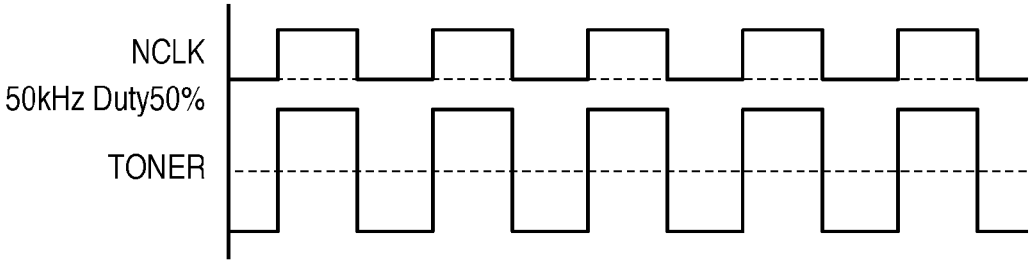
FIG. 13 is a diagram illustrating waveforms associated with AC voltage for detecting remaining amount of toner in the fifth embodiment of the present invention.
Figure 14:
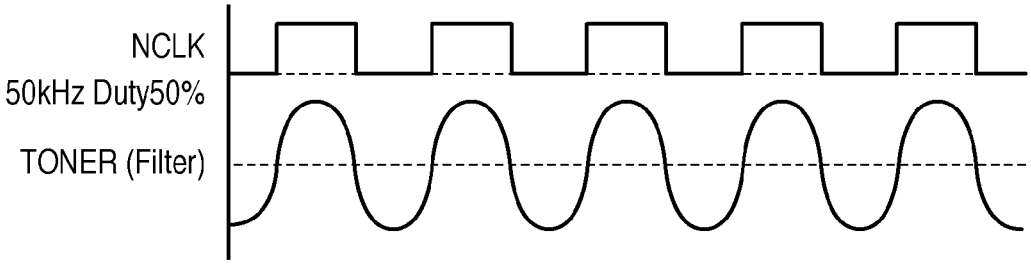
FIG. 14 is a diagram illustrating waveforms associated with AC voltage for detecting remaining amount of toner in the fifth embodiment of the present invention.
Figure 15:
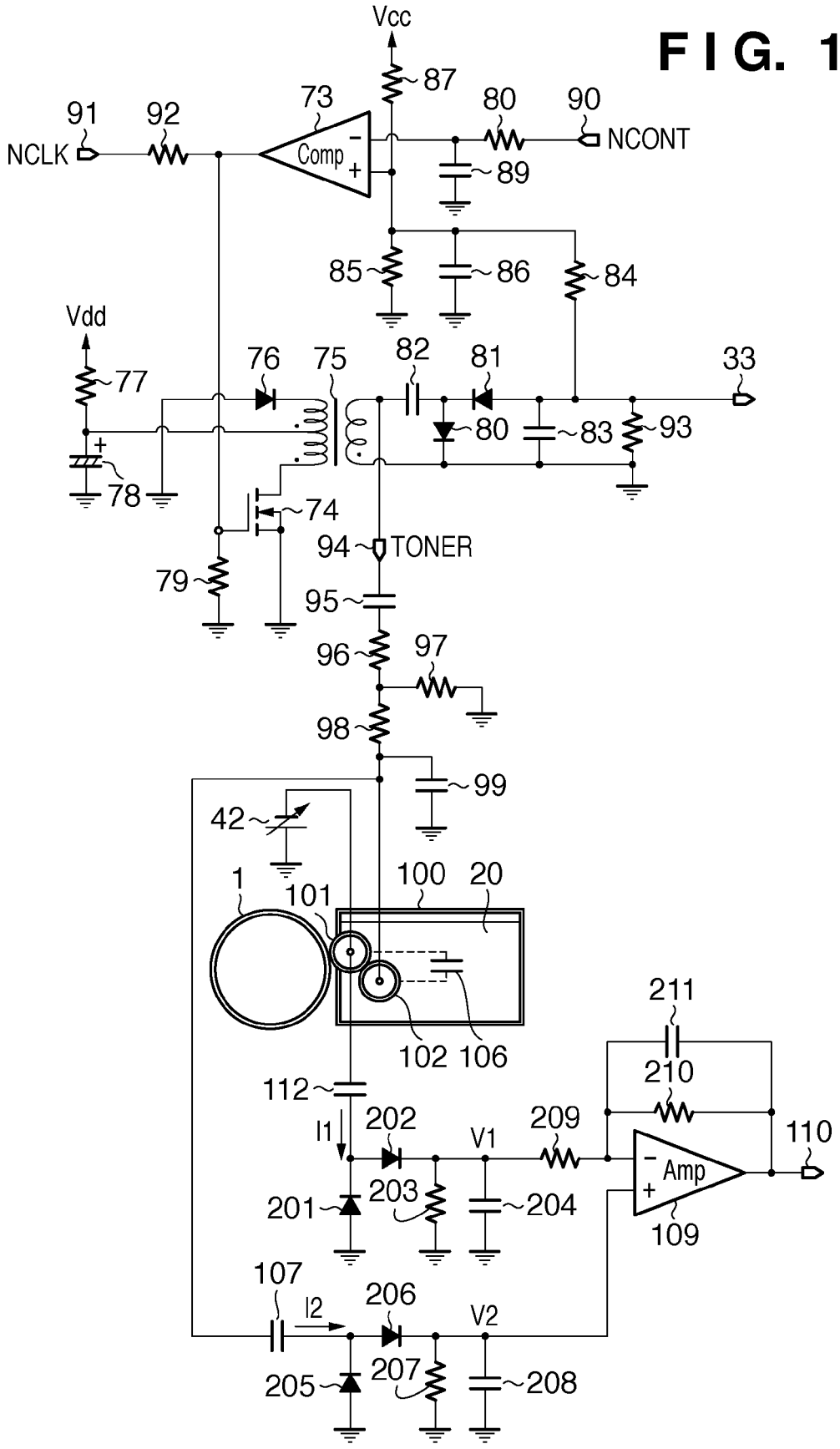
FIG. 15 is a diagram illustrating a mechanism for detecting remaining amount of toner in the fifth embodiment of the present invention.
Figure 16:
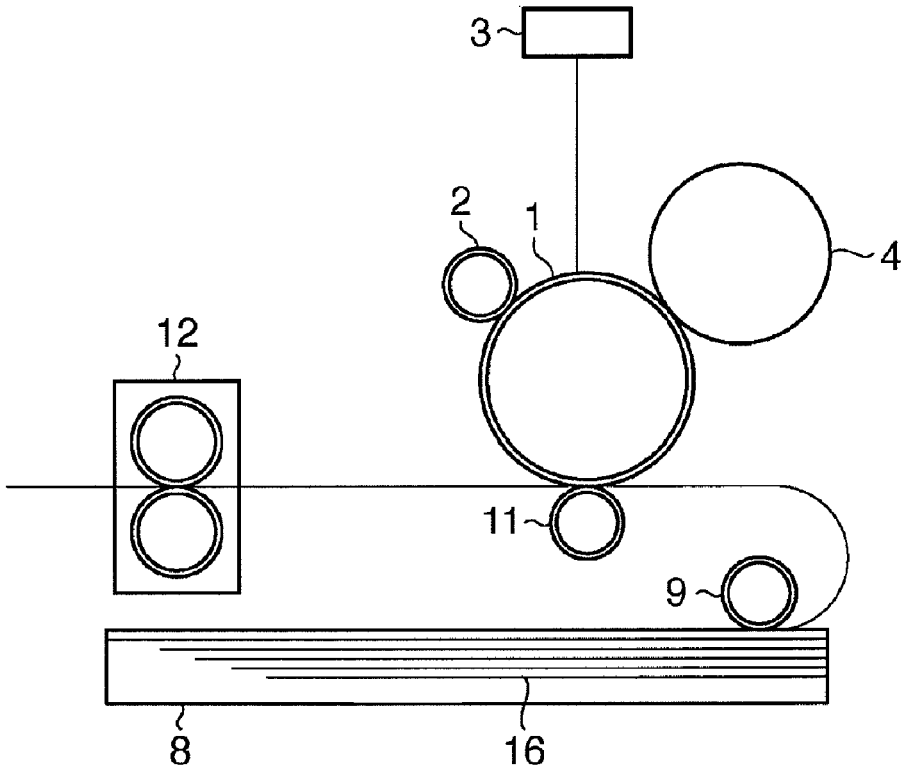
FIG. 16 PRIOR ART
FIG. 16 is a diagram illustrating the configuration of an image forming apparatus according to the prior art.
Figure 17:
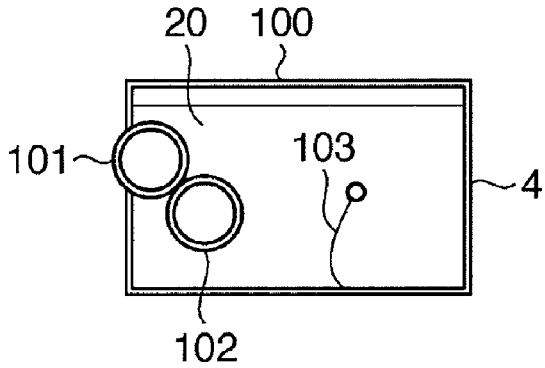
FIG. 17 PRIOR ART
FIG. 17 is a diagram illustrating the configuration of a developing unit used in the image forming apparatus according to the prior art.
Figure 18:
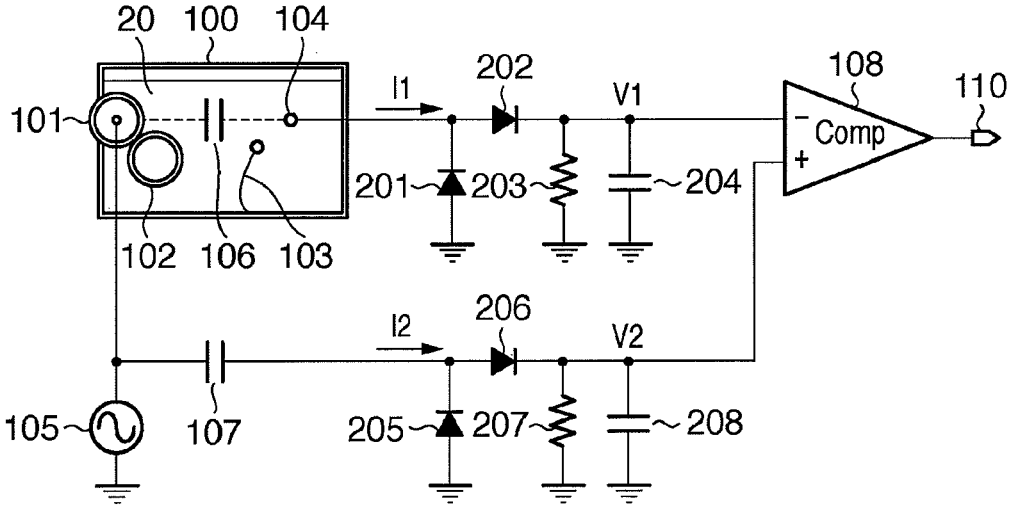
FIG. 18 PRIOR ART
FIG. 18 is a diagram illustrating the configuration of a mechanism for detecting remaining amount of toner by the electrostatic capacitance detection method according to the prior art.
Figure 19:
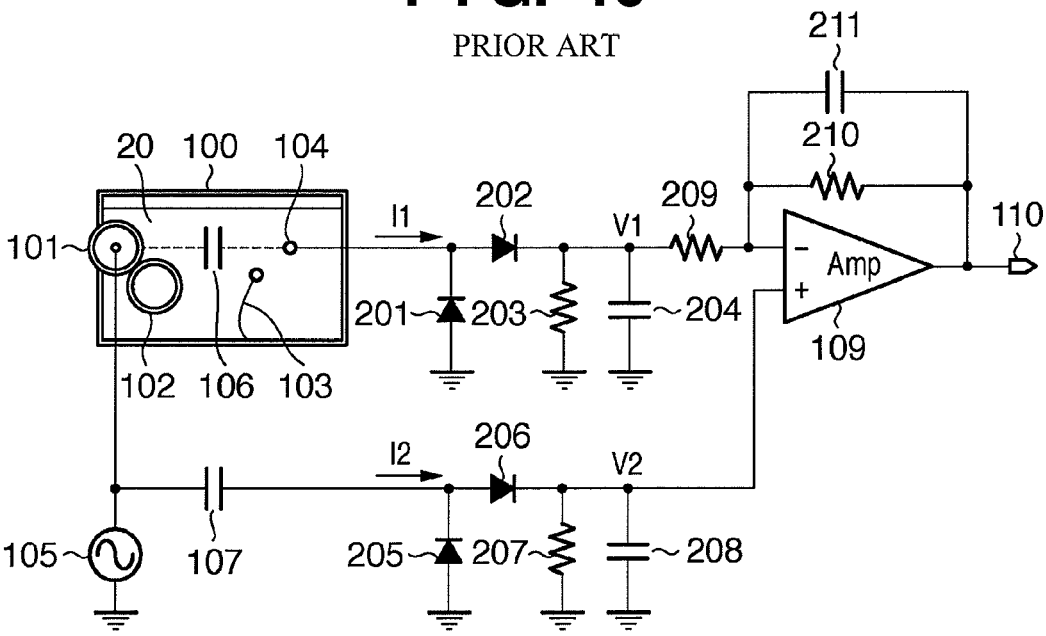
FIG. 19 PRIOR ART
FIG. 19 is a diagram illustrating the configuration of a mechanism for detecting remaining amount of toner by the electrostatic capacitance detection method according to the prior art.
Figure 20:
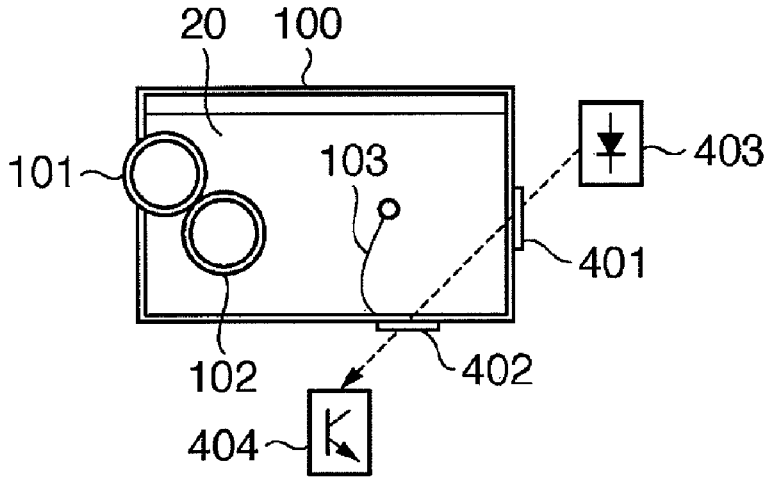
FIG. 20 PRIOR ART
FIG. 20 is a diagram illustrating the configuration of a mechanism for detecting remaining amount of toner by the optical transmission detection method according to the prior art.
Figure 21:
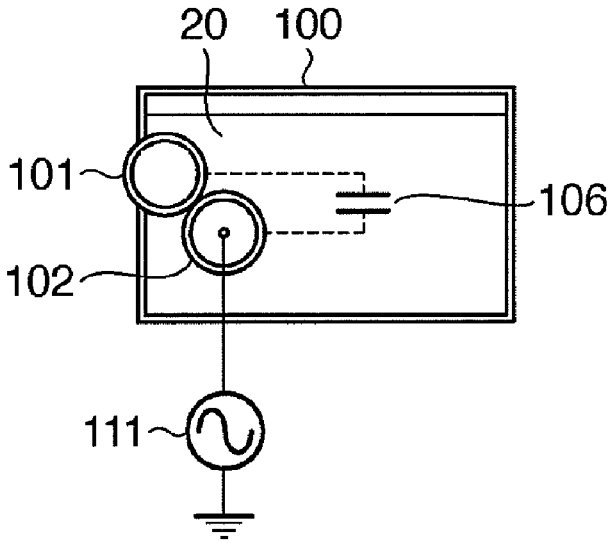
FIG. 21 PRIOR ART
FIG. 21 is a diagram illustrating the configuration of a developing unit used in the image forming apparatus according to the prior art.

For example, in a case where the clock signal 91 at the time of the cleaning sequence has a frequency of 50 kHz and a duty ratio of 10%, the duty ratio of the clock signal 91 is changed over to 50% when remaining amount of toner is detected. The waveform of the AC voltage 94 at this time is as shown in FIG. 13. The AC voltage 94 for detecting remaining amount of toner shown in FIG. 13 is a symmetrical square wave and the higher harmonic components are reduced in comparison with the AC voltage waveform shown in FIG. 12. The AC voltage waveform in FIG. 13 is ideal for application when detecting remaining amount of toner. Further, as shown in FIG. 15, the AC voltage 94 for detecting remaining amount of toner is applied to the RS roller 102 via potential dividing resistors 96, 97 and a low-pass filter composed of a resistor 98 and capacitor 99, by way of example. In this case, the waveform of the AC voltage 94 after passage through the low-pass filter is as depicted in FIG. 14. The AC voltage waveform shown in FIG. 14 is an approximate sine wave having a single frequency component and has fewer higher harmonic components in comparison with the AC voltage waveform shown in FIG. 13. The AC voltage waveform in FIG. 14 is ideal for application when detecting remaining amount of toner. Further, the arrangement of this embodiment is such that the AC bias for detecting remaining amount of toner can be made an approximate sine wave by changing over the driving frequency or duty ratio of the inverter means to a prescribed condition even in detection of the remaining amount of toner by the electrostatic capacitance detection method of the first embodiment. Thus, the low-pass filter corresponds to voltage adjusting and shaping means for adjusting and shaping the AC voltage, which has been obtained by branching the output of the transformer, and generating an approximate sinusoidal voltage.

Thus, an AC bias for detecting remaining amount of toner is applied at a timing different from that of the cleaning sequence and the driving frequency or duty ratio of inverter means is changed over to a prescribed condition. Furthermore, by constructing the voltage adjusting and adjusting means as means having the function of a transformer or low-pass filter, the AC bias for detecting remaining amount of toner is made an approximate sine wave and the accuracy with which the remaining amount of toner is detected can be improved. Further, the accuracy of detection of remaining amount of toner can be improved even in detection of remaining amount of toner by the electrostatic capacitance detection method in the first embodiment. The reason for this is that AC bias for detecting remaining amount of toner is made an approximate sine wave by changing over the driving frequency or duty ratio of inverter means to a prescribed condition.

It should be noted that the arrangement described in this embodiment can be modified appropriately so long as the modified arrangement is equivalent, and that the scope of the present invention is not limited solely to the arrangement illustrated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application Nos. 2007-322544, filed Dec. 13, 2007 and 2008-291503, filed Nov. 13, 2008, and which are hereby incorporated by reference herein in their entirety.

What is claimed is:

1. An image forming apparatus comprising:

a developer container containing a developer for developing an electrostatic latent image that has been formed on an image carrier;

a developer carrier for developing the electrostatic latent image by supplying the image carrier with the developer within said developer container;

an electrode member opposing said developer carrier via a space accommodating the developer inside the developer container;

a high-voltage power supply including:

an AC voltage generating circuit for generating an AC voltage by switching a DC voltage;

a transformer;

a rectifying circuit for rectifying the AC voltage received from said AC voltage generating circuit via said transformer and generating a DC voltage; and an AC voltage applying unit for applying the AC voltage, which is output from said transformer, to said electrode member; and a developer remaining-amount detection unit for detecting an amount of developer remaining inside said developer container based on electrostatic capacitance between said developer carrier and said electrode member.

2. The apparatus according to claim 1, wherein said electrode member is includes a conductor spaced a prescribed distance away from said developer carrier.

3. The apparatus according to claim 1, further comprising a switch for switching whether or not to apply the AC voltage from said AC voltage applying unit to said electrode member, wherein said switch operates in such a manner that the AC voltage from said AC voltage applying unit is applied to said electrode member in a period of time during which image formation is not being carried out.

4. The apparatus according to claim 1, further comprising:

a primary transfer unit for transferring a developer image, which has been formed on the image carrier, to an intermediate transfer member; and a secondary transfer unit for transferring the developer image, which has been transferred to the intermediate transfer member, to a printing medium, wherein the DC voltage generated by said rectifying circuit is a DC voltage applied to said developer carrier, a DC voltage applied to said primary transfer unit, or a DC voltage applied to said secondary transfer unit.

5. The apparatus according to claim 4, further comprising a cleaning unit for collecting developer remaining on the intermediate transfer member after the developer image has been transferred to the printing medium by said secondary transfer unit, wherein the DC voltage generated by said rectifying circuit is a DC voltage applied to said cleaning unit.

6. The apparatus according to claim 5, wherein a timing at which the DC voltage is applied to said cleaning unit is a timing at which said cleaning unit collects remaining developer.

7. The apparatus according to claim 6, further comprising an adjusting circuit for adjusting the AC voltage by a filter before the AC voltage is output from said AC voltage applying unit to said electrode member, wherein said AC voltage generating circuit is capable of changing over a switching frequency or a duty ratio at a timing at which the AC voltage is applied to said electrode member, and wherein said AC voltage generating circuit sets the switching frequency or the duty ratio in such a manner that the switching frequency or the duty ratio at the timing at which remaining developer is collected by said cleaning unit is different from the switching frequency or the duty ratio at the timing at which the AC voltage is applied to said electrode member.

8. An image forming apparatus comprising:

a developer container containing a developer;

a developer carrier for developing an image on an image carrier by supplying the image carrier with the developer within said developer container;

an electrode member opposing said developer carrier;

a high-voltage power supply including:

an AC voltage generating circuit for generating AC voltage by switching a DC voltage;

a transformer;

a rectifying circuit for rectifying the AC voltage received from said AC voltage generating circuit via said transformer and generating a DC voltage; and an AC voltage applying unit for applying the AC voltage, which is output from said transformer, to said electrode member; and a developer amount detection unit for detecting an amount of developer inside said developer container based upon an electrostatic capacitance between said developer carrier and said electrode member.

9. The apparatus according to claim 8, further comprising a switch for switching whether or not to apply the AC voltage from said AC voltage applying unit to said electrode member, wherein said switch operates in such a manner that the AC voltage from said AC voltage applying unit is applied to said electrode member in a period of time during which image formation is not being carried out.

10. The apparatus according to claim 8, further comprising:

a primary transfer unit for transferring a developer image, which has been formed on the image carrier, to an intermediate transfer member; and a secondary transfer unit for transferring the developer image, which has been transferred to the intermediate transfer member, to a printing medium, wherein the DC voltage generated by said rectifying circuit is a DC voltage applied to said developer carrier, a DC voltage applied to said primary transfer unit, or a DC voltage applied to said secondary transfer unit.

11. The apparatus according to claim 10, further comprising a cleaning unit for collecting developer remaining on the intermediate transfer member after the developer image has been transferred to the printing medium by said secondary transfer unit, wherein the DC voltage generated by said rectifying circuit is a DC voltage applied to said cleaning unit.

12. The apparatus according to claim 11, wherein a timing at which the DC voltage is applied to said cleaning unit is a timing at which said cleaning unit collects remaining developer.

13. The apparatus according to claim 12, further comprising an adjusting circuit for adjusting the AC voltage by a filter before the AC voltage is output from said AC voltage applying unit to said electrode member, wherein said AC voltage generating circuit is capable of changing over a switching frequency or a duty ratio at a timing at which the AC voltage is applied to said electrode member, and wherein said AC voltage generating circuit sets the switching frequency or the duty ratio in such a manner that the switching frequency or the duty ratio at the timing at which remaining developer is collected by said cleaning unit is different from the switching frequency or the duty ratio at the timing at which the AC voltage is applied to said electrode member.

14. The apparatus according to claim 8, wherein said electrode member is adapted to provide the developer to said developer carrier.

* * * * *